United States Patent [19]

Ziegelheafer

[11] 4,023,282

[45] May 17, 1977

[54] HEATED BOOT

[76] Inventor: Francis Ziegelheafer, Rte. No. 1, Box 69A, Delmar, Md. 19940

[22] Filed: Nov. 2, 1976

[21] Appl. No.: 738,311

[52] U.S. Cl. ..... 36/2.6; 126/206

[51] Int. Cl.[2] ..... A43B 7/02

[58] Field of Search ..... 36/2.6, 136; 226/204, 226/206

[56] References Cited

UNITED STATES PATENTS

| | | | |
|---|---|---|---|
| 752,516 | 2/1904 | Carney | 36/2.6 |
| 2,680,918 | 6/1954 | Behner | 36/2.6 |
| 3,585,736 | 6/1971 | Polichena | 36/2.6 |
| 3,712,288 | 1/1973 | Weiss | 126/206 |

*Primary Examiner*—Patrick D. Lawson

[57] ABSTRACT

An improved hunting boot is provided which includes means mounted therein for generating heat and directing the heat generated towards the wearer's toes. The improved boot generally comprises an overshoe including one or more panels fitted to the contour of the foot from ankle to toes adapted to overlie the wearer's foot, and a sole member extending from the wearer's heel to toes, generally contoured thereto and adapted to underlie the foot. A thermal sleeve overfits at least the portion of the overshoe housing the toes of the wearer and is adhesively secured to the sole member thereof. A conventional catalytic warmer may be removably mounted in the pocket provided by the thermal sleeve. Adhesively connected to the sole member of the overshoe is a replaceable tread.

1 Claim, 2 Drawing Figures

HEATED BOOT

BACKGROUND OF THE INVENTION

The instant invention relates generally to a boot construction, and more particularly to a heated hunting boot.

Winter hunting and fishing for sport requires special outfitting to withstand the cold. The extremities, particularly the feet, have a tendency to become cold, and sometimes even frostbitten.

Insulated boots are provided to protect the feet from the cold. However, after long periods in the cold, these insulated boots are insufficient for their intended purpose.

Accordingly, the instant invention provides means whereby the feet may be kept warm, even during prolonged periods of exposure to the cold.

SUMMARY OF THE INVENTION

Generally speaking, in accordance with the invention, an improved hunting boot is provided which includes means mounted therein for generating heat and directing the heat generated towards the wearer's toes. The improved boot generally comprises an overshoe including one or more panels fitted to the contour of the foot from ankle to toes adapted to overlie the wearer's foot, and a sole member extending from the wearer's heel to toes, generally contoured thereto and adapted to underlie the foot. A thermal sleeve overfits at least the portion of the overshoe housing the toes of the wearer and is adhesively secured to the sole member thereof. A conventional catalytic warmer may be removably mounted in the pocket provided by the thermal sleeve. Adhesively connected to the sole member of the overshoe is a replaceable tread.

Accordingly, it is an object of the invention to provide an improved heated hunting boot for prolonged use during winter sport hunting and fishing.

Another object of the invention is to provide a modified boot adapted to be heated during winter.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWING

For a fuller understanding of the invention, reference is had to the following description taken in connection with the accompanying drawing, in which.

DETAILED DESCRIPTION OF THE INVENTION

Figure 1:
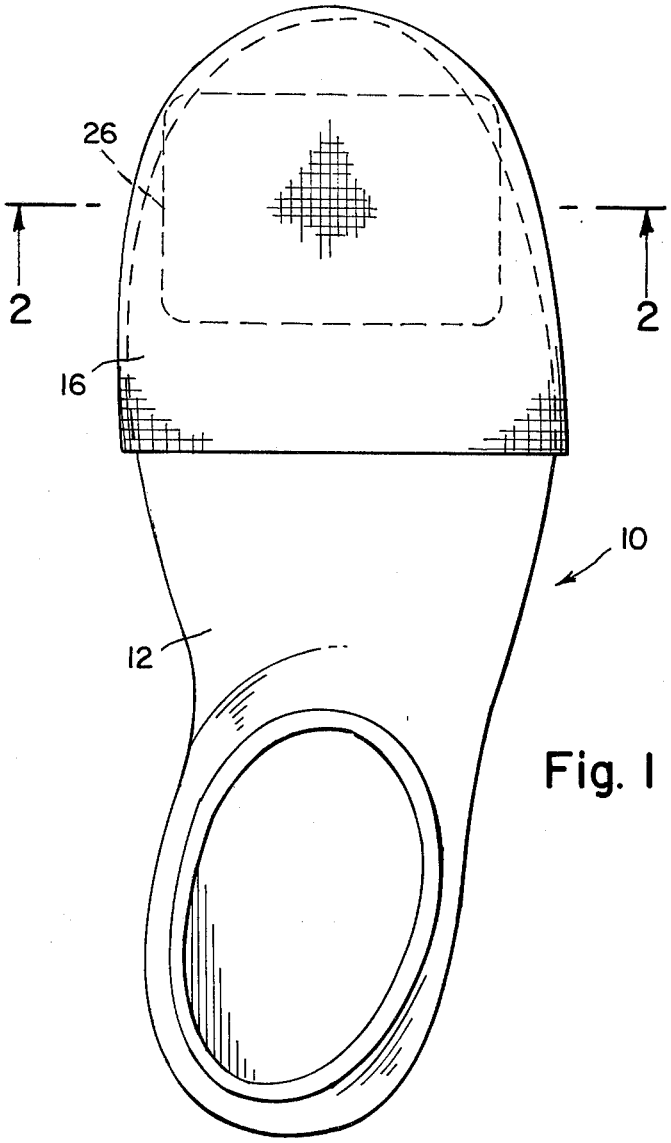
FIG. 1 is a top plan view of the improved boot constructed according to the instant invention.

Referring now to the drawing, the improved heatable hunting boot generally numbered 10 includes an overshoe 12 extending from the wearer's ankle to toes and conforming to the shape of the foot. Underlying overshoe 12 is a sole member 14 having the general outline of the wearer's foot.

Overlying at least the portion of overshoe 12 that houses the wearer's toes is a web 16 which is adhesively connected to boot 10, as at sole member 14 by an adhesive layer 18. In the interior surface of web 6 a layer of thermal insulation 20 is mounted. Underlying adhesive layer 18 and secured thereby to boot 10 is a replaceable wear resistant tread 22.

Figure 2:
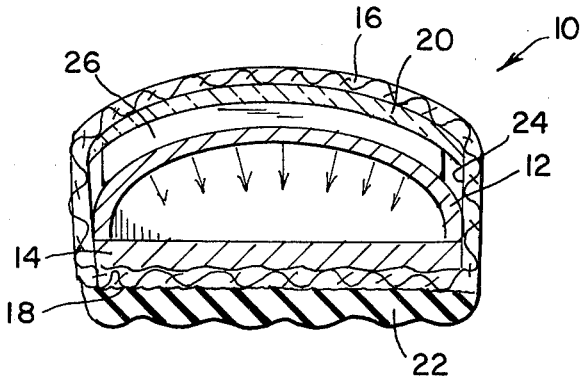
FIG. 2 is a sectional view of the boot seen in FIG. 1 taken along line 2—2 thereof.

Formed between the overshoe 12 and insulated web 16 is a pocket 24 in which a conventional catalytic hand warmer 26 may be removably mounted. Heat produced by the hand warmer 26 is directed inwardly towards the interior of the boot 10, as shown by the directional arrows in FIG. 2, because insulation layer 20 prevents convection thereof into the ambience.

Thus, the boot 10 is adapted to be heated during cold weather by the warmer 26. However, the warmer 26 may be demounted from the pocket 24 when the weather warms, and the boot 10 may be used during the various seasons. It is a significant feature of the invention that the boot 10 is not merely for seasonal use.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawing shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

What is claimed is:

1. An improved hunting boot comprising an overshoe including at least one panel fitted to a wearer's foot substantially from the ankle to toe, a sole member having an outline simulating the shape of the foot, said sole member underlying said at least one panel and extending from a wearer's heel to toes, a thermal sleeve overfitting at least a portion of said overshoe housing the toes of a wearer, said thermal sleeve being secured to said sole member of said overshoe, an adhesive layer, said thermal sleeve being secured to said sole member by said adhesive layer, said adhesive layer underlying said sole member, a pocket, said pocket being defined between said thermal sleeve and said at least one panel of said boot, a catalytic warmer, said catalytic warmer being removably mountable in said pocket, and a replaceable wear resistant tread adhesively secured to said adhesive layer.

* * * * *